US005589259A

United States Patent [19]

Hosoi et al.

[11] Patent Number: 5,589,259

[45] Date of Patent: Dec. 31, 1996

[54] INK JET RECORDING PAPER

[75] Inventors: Kiyoshi Hosoi; Tsukasa Matsuda, both of Ebina, Japan

[73] Assignee: Fuji Xerox Co., Ltd., Tokyo, Japan

[21] Appl. No.: 494,545

[22] Filed: Jun. 26, 1995

[30] Foreign Application Priority Data

Jun. 30, 1994 [JP] Japan ..... 6-149538

[51] Int. Cl.[6] ..... B41M 5/00

[52] U.S. Cl. ..... 428/323; 428/207; 428/211; 428/342

[58] Field of Search ..... 428/195, 211, 428/342, 323, 537, 207, 340, 341

[56] References Cited

FOREIGN PATENT DOCUMENTS

| | | |
|---|---|---|
| 59-35977 | 8/1984 | Japan . |
| 61-68286 | 4/1986 | Japan . |
| 61-68287 | 4/1986 | Japan . |
| 61-68288 | 4/1986 | Japan . |
| 62-162584 | 7/1987 | Japan . |
| 62-216785 | 9/1987 | Japan . |
| 63-1582 | 1/1988 | Japan . |
| 2-16078 | 1/1990 | Japan . |
| 2-117880 | 5/1990 | Japan . |
| 6-297833 | 10/1994 | Japan . |

*Primary Examiner*—Pamela R. Schwartz
*Attorney, Agent, or Firm*—Oliff & Berridge

[57] ABSTRACT

An ink jet recording paper having a coating layer applied in a low coating amount which is less apt to occur mixed color bleeding and unevenness in an image density of an ink, and which is excellent in image quality and strength of the coating layer. The ink jet recording paper comprises (a) a base paper having an apparent density of from 0.80 to 0.90 g/cm$^3$, an air permeability of from 5 to 15 seconds and a formation index of not less than 20; and (b) a coating layer provided on at least one surface of the base paper, the coating layer having a dried coverage of from 4 to 10 g/m$^2$ and mainly comprising (1) a white pigment having a BET specific surface area of from not less than 250 m$^2$/g to less than 400 m$^2$/g and (2) an aqueous adhesive.

6 Claims, No Drawings

INK JET RECORDING PAPER

FIELD OF THE INVENTION

The present invention relates to an ink jet recording paper. More particularly, the present invention relates to a recording paper suitable for color ink jet recording with an aqueous ink.

BACKGROUND OF THE INVENTION

Many proposals have heretofore been made to suppress mixed color bleeding on an ink jet recording paper. For example, JP-B-58-72495 (The term "JP-B" as used herein means an "examined Japanese patent publication") and JP-B-59-35977 propose that a large amount of a porous pigment be applied to a base paper to enhance the ink absorption capacity of the base paper. However, when the coating amount of the pigment is increased, it causes a deterioration in the strength of the recording paper. Such a recording paper generates powder falling when bent or rubbed. The powder thus fallen adheres to the running roll, to thereby prevent the roll from running, or to thereby clog the head. Further, this causes a rise in the cost of the recording paper.

On the other hand, JP-A-2-117880 (The term "JP-A" as used herein means an "unexamined published Japanese patent application") proposes a recording paper comprising (1) a coating layer applied in a low coating amount having a surface roughness index of not less than 10 ml/m$^2$ and a surface Beck smoothness of not more than 20 seconds, and (2) an ink-receiving layer having a fibrous substance present in the vicinity of the surface thereof. Further, JP-A-2-117880 proposes a recording paper for ink jet recording method comprising a coating layer applied in a low coating amount having a surface roughness index of not less than 10 ml/m2, in which the recording paper has a wetting time of not less than 10 msec as determined by Bristow's method and has a fibrous substance present in the vicinity of the recording surface. However, the coating layers of these recording papers have a rough surface and thus are disadvantageous in that an ink flows into the indented portion of the rough surface to cause mixed color bleeding. Further, since a fibrous substance is present in the vicinity of the ink-receiving layer, the ink penetrability can be easily affected by a base material. Accordingly, when the base material has an unevenness in ink penetrability, there occurs unevenness in an image density of particularly on solid printed areas and halftone printed areas.

Further, JP-A-2-16078 proposes a recording paper for ink jet recording method comprising (1) a base paper and (2) a surface layer applied in a low coating amount comprising a pigment and a fibrous substance contained in the base paper being incorporated into the surface layer in admixture. The recording paper exhibits an initial transition (ink absorption capacity in 10 msec contact of the recording paper with the ink according to Bristow's method) of not less than the maximum recording density (maximum amount of an ink given by the printer). The time during which the recording paper and the ink are brought into contact with each other (10 msec) according to Bristow's method, which defines the initial transition of recording paper, corresponds to the time in which the surface of the recording paper is wet with an ink. This wetting time is drastically affected by the surface roughness of the recording paper. Accordingly, in order to keep the initial transition in the contact time 10 msec greater than the jetted amount of an ink at the maximum recording density, the surface roughness of the recording paper must be raised. As a result, this recording paper is disadvantageous in that an ink flows into the indented portion of the roughness to cause mixed color bleeding, which cannot be avoided. This recording paper is also disadvantageous in that it has a surface layer comprising a pigment and a fibrous substance of base paper incorporated in the surface layer in admixture and thus tends to occur unevenness in an image density for the same reason as described above.

Moreover, JP-A-62-162584 proposes a recording paper mainly composed of wood pulp having a stöckigt sizing degree of not more than 40 seconds, an air permeability of not more than 50 seconds and a Beck smoothness of not more than 30 seconds. JP-A-63-1582 proposes a recording paper mainly composed of wood pulp having an air permeability/basis weight ratio of from 0.4 to 2.5. However, since these recording papers are of so-called ordinary type which has no porous pigment present on the base paper, they lack of color developability. Further, the ink penetrability can be easily affected by the base material. Accordingly, when the base material has an unevenness in ink penetrability, the recording paper tends to occur unevenness in an image density particularly on solid printed areas and halftone printed areas.

Further, the following proposals have been made to suppress the unevenness in an image density. JP-A-61-68286 proposes an ink jet recording process comprising printing an aqueous ink on a recording paper, in which the aqueous ink has a water content adjusted to from 10 to 90% by weight to enhance its absorbability, and the recording paper comprises a base paper having a basis weight of from 50 to 90 g/m$^2$ and a stöckigt sizing degree of from 5 to 100 seconds and a coating layer provided on the base paper. JP-A-61-68287 proposes an ink jet recording method with the use of the above-described recording paper and an ink having a viscosity adjusted to not more than 25 cp to enhance its absorbability. JP-A-61-68288 proposes an ink jet recording method with the use of the above-described recording paper and an ink having a surface tension of from 20 to 60 dyn/cm (20° C.), which is close to that of the recording paper, to predetermine the spread of dot. These methods are featured by the combination of specific recording paper and specific ink. However, the recording paper which is characterized only in the basis weight and st6ckigt sizing degree of the base paper cannot drastically suppress the unevenness in an image density.

JP-A-62-216785 proposes a recording paper composed of an uncoated base paper which exhibits a specified peak wavelength in the power spectrum of the shape of the recording surface in order to enhance the ink absorption capacity and improve the dot shape. However, since this recording paper has no coating layer, it exhibits a reduced ink absorption capacity and an insufficient color developability and resolution on the printed area. Further, since the ink is directly absorbed by the base paper, the ink penetrates into the base paper along fibers, to thereby cause mixed color bleeding and a poor dot shape. As a result, unevenness in an image density cannot be reduced sufficiently.

SUMMARY OF THE INVENTION

An object of the present invention is to provide an ink jet recording paper having a coating layer applied in a low coating amount which is less apt to occur mixed color bleeding and unevenness in an image density and exhibits excellent quality of an image recorded thereon and excellent strength of the coating layer.

Other objects and effects of the present invention will be apparent from the following description.

The above objects of the present invention have been achieved with an ink jet recording paper comprising a base paper having a coating layer applied thereon in a low coating amount, particularly applied to have a dried coverage of from 4 to 10 g/m$^2$, by paying attention to the apparent density, air permeability and formation index of the base paper.

One embodiment of the present invention is an ink jet recording paper, which comprises:

(a) a base paper having an apparent density according to JIS-P8118 (hereinafter simply referred to as "apparent density") of from 0.80 to 0.90 g/cm$^3$, an air permeability according to JIS-P8117 (hereinafter simply referred to as "air permeability") of from 5 to 15 seconds and a formation index of not less than 20; and (b) a coating layer provided on at least one surface of the base paper, the coating layer having a dried coverage of from 4 to 10 g/m$^2$ and mainly comprising (1) a white pigment having a BET specific surface area (hereinafter simply referred to as "specific surface area") of from not less than 250 m$^2$/g to less than 400 m$^2$/g and (2) an aqueous adhesive.

Another embodiment of the present invention is an ink jet recording paper comprising:

(a) a base paper having an apparent density of from 0.80 to 0.90 g/cm$^3$, an air permeability of from 5 to 15 seconds and a formation index of not less than 20; and (b) a coating layer provided on at least one surface of the base paper, the coating layer having a dried coverage of from 4 to 10 g/m$^2$ and mainly comprising (1) white pigments and (2) an aqueous adhesive, in which the white pigments contain a white pigment having a specific surface area of from not less than 100 m$^2$/g to less than 250 m$^2$/g in an amount of from 10 to 50% by weight, and a white pigment having a specific surface area of from not less than 250 m$^2$/g to less than 400 m$^2$/g in an amount of from 50 to 90% by weight, based on the total weight of the white pigments.

A further embodiment of the present invention is one of ink jet recording papers as described above, in which a coating solution for the coating layer contains the white pigment(s) in an amount of from 50 to 85% by weight based on the total weight of the coating solution.

A still further embodiment of the present invention is one of ink jet recording papers as described above, in which the base paper exhibits a stöckigt sizing degree according to JIS-P8122 (hereinafter simply referred to as "stöckigt sizing degree") of from 5 to 70 seconds.

DETAILED DESCRIPTION OF THE INVENTION

The present inventors made extensive studies to solve the foregoing problems, particularly to suppress mixed color bleeding and unevenness in an image density on an ink jet recording paper comprising a base paper and a thin coating layer having a dried coverage of from 4 to 10 g/m$^2$. As a result, it was found that mixed color bleeding and unevenness in an image density can be reduced by providing an ink jet recording paper comprising a base paper having a relatively high apparent density, a low air permeability and a high formation index, and a coating layer comprising a white pigment having a specific surface area of from not less than 250 m$^2$/g to less than 400 m$^2$/g or a coating layer comprising a white pigment having a specific surface area of from not less than 100 m$^2$/g to less than 250 m$^2$/g in an amount of from 10 to 50% by weight, and a white pigment having a specific surface area of from not less than 250 m$^2$/g to less than 400 m$^2$/g in an amount of from 50 to 90% by weight, each based on the total weight of white pigments. Thus, the present invention has been achieved.

Since a recording paper provided with a thin coating layer cannot fully absorb an ink by the coating layer, the unabsorbed ink must be absorbed by the base paper. Therefore, the penetration of the ink into the recording paper is affected by the base paper. When the apparent density of the base paper increases, internal voids of the base paper is reduced, to thereby reduce its ink penetrability. The reduced ink penetrability tends to cause mixed color bleeding. On the other hand, when the base paper has a poor formation and thus has a minute variation in its basis weight distribution, the internal voids are unhomogeneously distributed. In such a base paper, the ink penetrability particularly on a high basis weight (high density) portion, is deteriorated and the base paper tends to occur mixed color bleeding.

In view of the above, a base paper of a recording paper is required to have a low apparent density and to improve a formation index in order to suppress mixed color bleeding.

When the apparent density of the base paper decreases, the internal void of the base paper is enlarged. A coating solution applied onto such a base paper easily penetrates into the base paper, resulting in a thin coating layer. Thus, the penetration of ink to the recording paper is affected by the properties of the base paper. That is, if the base paper has unevenness in ink penetrability, the ink deeply penetrates into the base paper on high penetrable portions to provide a small dot diameter while the ink spreads horizontally on the less penetrable portions to provide a large dot diameter, resulting in some variation in dot diameter among the portions and hence causing unevenness in an image density.

Further, when the formation of the base paper is poor, that is, the base paper has a minute variation in its basis weight distribution, there occurs some variation in size of voids between fibers of the base paper, causing unevenness in an image density. In other words, the ink deeply penetrates into the base paper on portions which have a large void between fibers of the base paper and thus can easily absorb the ink to provide a small dot diameter while the ink spreads horizontally on the portions which have a small void and thus can hardly absorb the ink to provide a large dot diameter, resulting in some difference in dot diameter among the portions and hence causing unevenness in an image density.

Moreover, when a coating solution for forming a coating layer is applied to a base paper having a poor formation, a thickness of the coating layer becomes more thin on portions having low basis weight which have many and large voids between fibers and thus can easily absorb the coating solution, while a thickness of the coating layer becomes more thick on portions having high basis weight. The thin portions in the coating layer have a low ink absorption capacity and thus provide a large dot diameter while the thick portions of the coating layer have a high ink absorption capacity and thus provides a small dot diameter. Thus, the unevenness in thickness of a coating layer and ink absorption capacity of the coating layer causes unevenness in an image density.

In view of the above, a base paper of a recording paper is required to have a high apparent density to suppress the unevenness in an image density, and further required to improve a formation index to suppress the unevenness in ink absorbability.

As described above, it has been made clear that mixed color bleeding and unevenness in an image density are both due to apparent density of the base paper and each are incompatible. In order to suppress mixed color bleeding and unevenness in an image density simultaneously, the inventors have found a condition of a base paper which has both a high capacity in ink absorption and a high apparent density. That is, the ink absorption capacity of the base paper can be enhanced by reducing the air permeability of the base paper. The present inventors found that even a base paper having a high apparent density can be prevented from both mixed color bleeding and unevenness in an image density by reducing the air permeability thereof while keeping the formation index thereof high. Thus, the present invention has been achieved.

Further, the present invention is based on the finding that mixed color bleeding on a recording paper can be still more reduced by incorporating a pigment having a small specific surface area, to a coating layer, because the incorporation of such a pigment somewhat suppress ink penetration into the coating layer and further prevent the horizontal spread of the ink.

The present invention relates to an ink jet recording paper comprising (a) a base paper having an apparent density of from 0.80 to 0.90 g/cm$^3$, an air permeability of not more than 15 seconds, a formation index of not less than 20, and preferably having a basis weight of from 70 to 90 g/m$^2$ and a stöckigt sizing degree of from 5 to 70 seconds, and (b) a coating layer, provided on at least one surface of the coating layer, having a dried coverage of from 4 to 10 g/m$^2$ and mainly comprising an aqueous adhesive and a white pigment having a specific surface area of from not less than 250 m$^2$/g to less than 400 m$^2$/g, or white pigments containing a white pigment having a specific surface area of from not less than 100 m$^2$/g to less than 250 m$^2$/g in an amount of from 10 to 50% by weight and a white pigment having a specific surface area of from not less than 250 m$^2$/g to less than 400 m$^2$/g in an amount of 50 to 90% by weight, each based on the total weight of white pigments.

In the ink jet recording paper of the present invention, the apparent density of the base paper is from 0.80 to 0.90 g/cm$^3$, preferably from 0.82 to 0.88 g/cm$^3$.

When the apparent density of the base paper falls below 0.80 g/cm$^3$, a coating solution for the coating layer easily penetrate into the base paper in applying the coating solution resulting in a thin coating layer that tends to occur unevenness in an image density. Furthermore, resinous components in the coating solution penetrate into the base paper in applying the coating solution, to thereby cause a deterioration in the strength of the coating layer. On the contrary, when the apparent density of the base paper exceeds 0.90 g/cm$^3$, the base paper exhibits a reduced ink absorption rate, and thereby the recording paper tends to occur mixed color bleeding.

The apparent density of the base paper can be adjusted by selecting the kind of pulp used, the beating degree of pulp used, the wet-pressing degree of pulp used, the kind or the amount of the filler used, the calendaring degree of pulp used, or combination thereof. However, the method to adjust the apparent density of the base paper in the present invention are not limited thereto. The apparent density in the present invention is determined in accordance with JIS-P8118.

In the apparent density measurement, the thickness of a paper is measured under a certain static load being placed between two parallel disks of a micrometer. The micrometer to be used shall be a dial gauge type and shall also conform the following conditions:

(1) The micrometer shall provide two parallel plane faces, and the smaller face shall be approximately 14.3 mm in diameter. Furthermore, the error of parallelism between these two faces shall fall within the accuracy of 0.005 mm, and the micrometer shall provide such structure that the faces can move perpendicular to each face.

(2) During a test piece is placed between the beforementioned plane faces, a constant pressure, 0.55 ±0.05 kgf/cm$^2$ (53.9 ±4.9 kPa) shall be exerted.

(3) The graduation on a dial plate shall be read at least to 0.002 mm in thickness.

(4) At a zero point of a micrometer, or in the case where a steel block gauge is interposed between the gap, a micrometer shall be capable of repeatability of reading with an accuracy of 0.0002 mm, if the thickness of the gauge is 3 mm or less.

The measurement of apparent density shall be carried out in the ambience which conforms to the conditions specified in JIS-P8111. The paper for measurement shall be placed upon the lower disk of a micrometer, raise the plunger until the lower end thereof reaches to the position approximately 0.6 mm apart from the surface of the paper, and release at this position. As a rule, at least 10 sheets of test pieces of which each of them is more than 50 mm square in area shall be prepared and measured. The paper for measurement shall be taken in accordance with JIS-P8110 and free from wrinkles. Concerning these 10 test pieces, at least two positions shall be determined on respectively. In this case, lower the plunger once per one position. In the case of thinner paper such as condenser paper, however, the thickness may be determined by measuring piled several sheets thereof and dividing the measured value by the number of sheets used.

The thickness shall be expressed in mm, and rounded off to three places of decimals according to JIS-Z8401 to report. In this case, the maximum, minimum value and number and size of paper for measurement shall be reported. In the case of reporting specific volume or density, it shall be expressed by C.G.S. unit, and rounded off to two places of significant figures according to JIS-Z8401. When several sheets of paper are piled for measurement, this matter shall be additionally noted. The specific volume (V) and apparent density (D) shall be calculated by the following formula:

$$V = \frac{T \times 1000}{W}$$

$$D(\text{g/cm}^3) = \frac{W}{T \times 1000}$$

wherein, T represents a thickness (mm) and W represents a basis weight (g/m$^2$ ).

The air permeability of the base paper is from 5 to 15 seconds, preferably from 5 to 13 seconds. When the air permeability of the base paper exceeds 15 seconds, the base paper exhibits a reduced ink absorption rate, and thereby the recording paper tends to occur mixed color bleeding. On the contrary, when the air permeability of the base paper falls below 5 seconds, the density of the base paper must be reduced, which induce a remarked unevenness in an image density.

The air permeability of the base paper can be adjusted by selecting the kind of wood used, the kind of pulp used, the beating degree of pulp used, the fibrillating degree of pulp used, the ash content, the kind of filler used, the shape of filler used, and whether or not the material is calendered, or combination thereof. However, the method to adjust the air permeability of the base paper in the present invention is not limited thereto. The air permeability in the present invention is determined in accordance with JIS-P8117.

The testing device for measuring air permeability in JIS-P8117 is divided into two types, Types A and B, consisting of an outer cylinder partly filled with oil and an inner cylinder which can freely slide in the outer cylinder and having an open or closed top. In Type B, the cylinder is of concentric double cylinder construction, having an open top, containing the oil in itself, and the inner cylinder forms an air passage reaching the lower clamping plate. Air pressure for measurement shall be provided by the mass of the inner cylinder.

The testing device shall be of a construction capable of applying an air pressure onto the test piece held between the clamping plates having a circular orifice of 28.6±0.1 mm in diameter. The clamping plates may form the top of the inner cylinder (in Type A) or may be mounted in the base of the testing device (in Type B). (The latter construction is preferable.) An elastic gasket shall be attached to the clamping plate on the side exposed to air pressure, and the test piece shall be held in contact with the gasket when clamped for measurement.

The gasket shall consist of a thin, elastic, oil-resistant, nonoxidizing material having a smooth surface and capable of preventing air from leaking through the test piece and the clamping plate. An oil-resistant rubber, such as grade S.T. Thiokol gasket of 0.79 mm in thickness, and of 50 to 60 in Durometer hardness, is a satisfactory gasket material. The inside diameter of the gasket shall be 28.6 mm and the outside diameter 34.9 mm. The bolt holes in the gasket shall be centered exactly to those in the clamping plate, and, in order to align and protest the gasket in use, it shall be cemented with shellac into a groove machined in the clamping plate. This groove shall be concentric with the aperture in the opposite orifice plate, and 28.4 mm in inside diameter, 35.2 mm in outside diameter and 0.5 mm in depth for convenience in inserting and attaching the gasket. The outer cylinder shall be 254 mm high and shall have an internal diameter of 82.5 mm, and marked with a level line at 127 mm from the inner bottom.

The outer cylinder shall be equipped with four bars, each 190 mm in length, 2.4 mm in width and 2.4 mm in thickness, on the inner surface to act as guide tracks for the inner cylinder. The inner cylinder shall be graduated in units of 50 ml, and shall have a total range of 350 ml. It shall be 254 mm high, and shall have an external diameter of 76.2 mm, an internal diameter of 74 mm and a mass of 567±1.0 g. Or, the inner cylinder may be graduated in units of 25 ml for the first 100 ml and have a range of 400 ml.

The oil used in the testing device shall be a lubricating oil having 60 to 70 seconds Saybolt Universal viscosity at 37.8° C. {10 to 13 $mm^2$ / s} and a flash point of not less than 135° C. A light spindle oil is suitable for this purpose. Oil is used in preference to water, because it does not affect the moisture content of the sample nor does it affect the aluminium inner cylinder. The oil shall not contain any essential oil or easily volatile oil.

The measurement of air permeability shall be carried out under the atmospheric conditions as described in JIS-P8111. Place the testing device on a level surface so that the inner cylinder becomes vertical. Fill the outer cylinder with oil to the level line of 127 mm depth marked on the inner surface of the cylinder.

If Type A device having the clamp in the top of the inner cylinder is used, raise the inner cylinder, hold it in a raised position with one hand, clamp the test piece between clamping plates, then lower the cylinder, and allow it to float on the oil.

If Type B device is used, take out the inner cylinder, clamp the test piece, insert the inner cylinder into the outer cylinder, gradually lower the-inner-cylinder, and allow it to float on the oil.

When the device having the clamp in the base is used, first raise the inner cylinder until its stop rim is supported by the catch, clamp the test piece between the clamping plates, then gently lower the inner cylinder until it floats. When the steady movement of the inner cylinder has been attained, measure with a stopwatch or other timing device the number of seconds required for the graduations from 0 to 100 ml to pass the rim of at the end of first 50 ml graduation, and the results doubled. For porous papers, the number of seconds for 100 ml or over may be read, and converted to the 100 ml standard volume.

The measurement shall be made for at least five test pieces for each top side and back side, and take the average of the results. However, for heterogenous papers, make test for not less than 10 test pieces, and take the average by discarding extraordinary values.

In clamping the test piece, do it with the cylinder suspended with one hand, and fasten the nuts alternatively so that the pressures on both sides become equal to each other. Take care not to excessively fasten the nut on either side alone, or it can cause air leakage through the clamping plate and the test piece.

The formation index of the base paper for use in the present invention is not less than 20, preferably not less than 25. When the formation index of the base paper falls below 20, it induces mixed color bleeding and unevenness in an image density. The formation index in the present invention is determined by using a 3D sheet analyzer (M/K950, manufactured by M. K. Systems Co., Ltd) with a stop of its photodetector being adjusted to a diameter of 1.5 mm.

In the measurement of formation index, a sample is placed on a rotary drum of the 3D sheet analyzer. Using a light source mounted on the drum shaft and a photodetector mounted opposed to the light source and outside of the drum, a local difference of a basis weight in the sample is measured as a difference in the amount of light. The range of measurement is defined by the diameter of the stop mounted at the inlet of the photodetector. The difference in the amount of light (deviation) is amplified, analog-digital converted, and then classified into 64 optically measurable basis weight grades. 100,000 data are measured per scan. These data are then represented in histogram. The maximum frequency (peak value) in the histogram is then divided by the number of grades having a frequency of not less than 100 in the classes corresponding to the 64 minute basis weight grades. The resulting value is then divided by 100 to produce a formation index. The greater the formation index is, the better is the formation.

Methods for improving the formation of the base paper include a method providing a screen or an eddy type cleaner in immediately front of a head box of a paper-making machine so as not to fix the flowing direction of a paper stock, and a method controlling a flocculation of a paper stock by adding a known additive such as guar gum, locust bean gum, mannogalactan, deacetylated karaya gum, alginate, carboxymethyl cellulose, methyl cellulose and hydroxyethyl cellulose. However, the methods are not limited thereto.

The base paper for use in the present invention generally comprises a wood pulp as a main raw material, and a filler is generally added to the base paper. The filler for use in the present invention is a white filler such as light or heavy calcium carbonate, talc, kaolin, clay, titanium dioxide, zeolite and white carbon. Of these fillers, calcium carbonate is particularly preferred because it remarkably enhances a color developability of coloring materials. The amount of a filler added to the base paper for use in the present invention is generally from 5 to 30% by weight, preferably from 10 to 25% by weight, based on the total weight of the base paper to increase the void in the base paper and to enhance the opacity. When the content of the filler exceeds 30% by weight, the base paper exhibits a reduced strength and thus shows a marked tendency to generate paper powder.

The base paper is preferably prepared in such a manner that the basis weight thereof is preferably from 70 to 90 g/m$^2$, more preferably from 72 to 87 g/m$^2$. When the basis weight of the base paper falls below 70 g/m$^2$, the image formed on the base paper can be more easily seen through the base paper. On the contrary, when the basis weight of the base paper exceeds 90 g/m$^2$, the base paper exhibits an increased strength and hence an increased buckling strength, to thereby tend to cause a trouble in transportation through the recording apparatus.

The stöckigt sizing degree of the base paper is preferably from 5 to 70 seconds, and more preferably from 10 to 60 seconds. When the stöckigt sizing degree of the base paper falls below 5 seconds, an ink can reach the back side of the base paper, making the image more remarkably visible from the back side. On the contrary, when the stöckigt sizing degree of the base paper exceeds 70 seconds, the base paper in whole is rendered more susceptible to the effect of the sizing agent and thus exhibits a reduced wettability to a coating solution for forming the coating layer. A coating solution applied is liable to run away on such a base paper and thus the coating layer cannot be formed uniformly. As a result, the recording paper comprising such a base paper causes mixed color bleeding or unevenness in an image density. The stöckigt sizing degree of the present invention is determined in accordance with JIS-P8122.

In the measurement of stöckigt sizing degree, ten sheets of test piece of 50 mm square in size without folds, wrinkle, water mark and stain shall be sampled from different parts of a sample paper, and shall be subjected to the pretreatment under the conditions specified in JIS-P8111 (Conditioning of Paper and Paperboard for Test).

The measurement of stöckigt sizing degree shall be made under the standard atmospheric conditions specified in JIS-P8111. Fold up four edges of a test piece to float the test piece on the solution of 2% ammonium thiocyanate (specified in JIS-K9000) of 20°±1° C. contained in a laboratory dish (schale), immediately measure with a stop watch the time from dropping one drop of the 1% ferric chloride solution (special class of JIS-K8142) of the same temperature with a pipette until three red spots appear on the paper, and count the time in seconds as the stöckigt sizing degree.

Measurements shall be made for every side of the test piece five times to obtain the total mean value, maximum value and minimum value, whose values below seconds are rounded off, and the results shall be reported.

The coating solution for use in the present invention comprises a white pigment having a specific surface area of from 250 to 400 m$^2$/g, preferably from 300 to 400 m$^2$/g, and preferably having an average particle diameter of from 2 to 15 μm. Examples of the white pigment for use in the present invention include amorphous silica, alumina, etc. Of these, amorphous silica is most suitable. When the specific surface area of the white pigment falls below 250 m$^2$/g, the coating layer exhibits a reduced ink absorption capacity and thus tends to occur mixed color bleeding and gives an insufficient color developability. On the contrary, when the specific surface area of the white pigment exceeds 400 m$^2$/g, the pigment exhibits a reduced hardness and hence is an extremely soft pigment, rendering the coating layer difficult to be written by pencil or the like. When the average particle diameter of the pigment falls below 2 μm, the coating layer is hardly written by pencil or the like. On the contrary, when the average particle diameter of the pigment exceeds 15 μm, a surface roughness of the coating layer becomes greater. On the indented area of the coating layer, the ink flows horizontally. As a result, the shape of the resulting ink dots becomes ununiform, causing density unevenness or mixed color bleeding.

The coating solution of the coating layer for use in the present invention contains white pigment(s) in an amount of from 50 to 85% by weight, preferably from 60 to 80% by weight, based on the total weight of the coating solution. When the content of white pigments falls below 50% by weight, the same adverse effects as in the case where the specific surface area of a white pigment is less than 250 m$^2$/g are seen. On the contrary, when the content of white pigments exceeds 85% by weight, the coating layer exhibits a reduced strength and thus tends to generate powder falling and is difficult to be written by pencil or the like.

In order to further suppress mixed color bleeding, an additional white pigment having a specific surface area of from not less than 100 m$^2$/g to less than 250 m$^2$/g is preferably added to the foregoing white pigment having a specific surface area of from not less than 250 m$^2$/g to less than 400 m$^2$/g, and mixed. The mixing ratio of the additional white pigment having a specific surface area of not less than 100 m$^2$/g to less than 250 m$^2$/g is preferably from 10 to 50% by weight, and the mixing ratio of the white pigment having a specific surface area of from not less than 250 m$^2$/g to less than 400 m$^2$/g is preferably from 50 to 90% by weight, each based on the total weight of white pigments. The white pigments for use in the present invention particularly preferably comprises a white pigment having a specific surface area of from not less than 150 to less than 200 m$^2$/g in an amount of from 20 to 40% by weight, and a white pigment having a specific surface area of from not less than 250 m$^2$/g to 400 m$^2$/g in an amount of from 60 to 80% by weight, each based on the total weight of white pigment.

Examples of the additional white pigment for use in the present invention include amorphous silica, alumina, etc. Of these, amorphous silica is most suitable. When the specific surface area of the additional white pigment is less than 100 m$^2$/g, it gives an insufficient color developability. As the specific surface area of the additional white pigment is reduced, the coating-layer is more liable to occur mixed color bleeding. When the specific surface area of the additional white pigment is more than 250 m$^2$/g, the above effect of further suppressing mixed color bleeding does not appear. Further, when the mixing ratio of the additional white pigment having a specific surface area of not less than 100 m$^2$ to less than 250 m$^2$/g is less than 10% by weight, the effect of further suppressing mixed color bleeding does not appear. When the mixing ratio of the additional white pigment is more than 50% by weight, it gives an insufficient color developability. And further, as the mixing ratio of the additional white pigment is increased, the coating layer is more liable to occur mixed color bleeding.

When amorphous silica is used as the white pigment, the amorphous silica may be modified with cationic metallic ions such as Ca ion, Al ion, Mg ion, etc. to impart water-resistance, light-resistance, etc.

Examples of the aqueous adhesive contained in the coating solution include polyvinyl alcohol derivatives such as fully-saponified polyvinyl alcohol, partially-saponified polyvinyl alcohol and silanol-modified vinyl alcohol copolymer; cellulose derivatives such as carboxymethyl cellulose, hydroxyethyl cellulose and hydroxylpropylmethyl cellulose; and water-soluble high molecular compounds such as polyvinyl pyrrolidone, oxidized starch, modified starch, gelatin and casein. These aqueous adhesive may be used alone or in combination. Of these, polyvinyl alcohol high molecular compounds such as fully-saponified polyvinyl alcohol, partially-saponified polyvinyl alcohol and silanol-modified vinyl alcohol copolymer is preferred for imparting a high strength to the coating layer. Of the polyvinyl alcohol high molecular compounds, a silanol-modified vinyl alcohol copolymer is particularly preferred because it can provide a excellent enhancement of the strength of the coating layer, and makes it possible to increase the content of a pigment for making up for the deficiency of dyes in an ink.

The coating layer for use in the present invention may contain a waterproofing agent to impart water-resistance to the coating layer for an image recorded thereon with an aqueous ink. Examples of the waterproofing agent include a high molecular amine compound such as polyethyleneimine and polyacrylamine salt, quaternary salt thereof; cationic aqueous high molecular compound such as a copolymer of acryl compound and ammonium salt; and water-soluble metallic salt. The waterproofing agent may be used alone or in combination. Although the addition amount of the waterproofing agent depends on the kind of a waterproofing agent used, the amount is generally from 1 to 10% by weight based on the total weight of the coating solution. Further, the coating layer may contain a fluorescent brightener, a surfactant, a mildrewproofing agent, a dispersant, etc. as needed.

The ink jet recording paper of the present invention is prepared by applying the above-described coating solution onto at least one surface of the base paper so as to form a coating layer having a dried coverage of from 4 to 10 g/m$^2$, preferably from 5 to 8 g/m$^2$. The term "a dried coverage" means an coating amount of coated materials remaining after dried per area. When the dried coverage of the coating layer falls below 4 g/m$^2$, fibers of the base paper are present with the coated material in the coating layer, to cause unevenness in ink penetrability, which result in ununiformity in dot diameter and unevenness in an image density. On the contrary, when the dried coverage of the coating layer exceeds 10 g/m$^2$, the coating layer itself exhibits a reduced strength.

The application of the coating solution can be conducted by using a reverse coater, air knife coater, blade coater, gate roll coater or the like.

In the present invention, the surface of the recording paper is preferably finished by calendaring or the like to have a Beck smoothness of not less than 25 seconds, preferably from 25 to 100 seconds, so that a dot having a shape of almost perfectly round with little tooth on its periphery can be recorded thereon.

Thus, although comprises a base paper having a high apparent density, the ink jet recording paper of the present invention exhibits excellent ink penetrability in spite of the thin coating layer by adjusting the property of the base paper, that is, lowering the air permeability and raising the formation index. Since the base paper of the present invention has a uniform void distribution and the thickness of the coating layer formed thereon is uniform, the ink penetrability is uniform all over the recording paper of the present invention. As a result, no mixed color bleeding occur even in ink jet recording with a known aqueous ink. Further, no unevenness in an image density occur in solid or halftone recording. The image recorded on the recording paper of the present invention exhibits an excellent color definition and resolution, and the coating layer of the recording paper exhibits a sufficient strength.

Accordingly, the recording paper of the present invention is also useful in ink jet recording with known aqueous inks. Thus, the present invention is not limited by the kind of an aqueous ink.

The present invention will be further described in the following examples, but the present invention should not be construed as being limited thereto. All the parts, percents, ratios and the like are by weight unless otherwise indicated.

EXAMPLE 1

A pulp composed of a 3:1 mixture of Laubholz Bleaching Kraft Pulp (LBKP) and Nadelholz Bleaching Kraft Pulp (NBKP) was beaten to a freeness of 450 ml C.S.F. Calcium carbonate light (TP121, manufactured by Okutama Kogyo K. K.) was then added to the pulp as a filler to be in an amount of 10% by weight based on the total weight of a base paper. Alkenyl succinic anhydride (Fiverun 81, manufactured by Oji National Co., Ltd.) was added thereto as an internal sizing agent in an amount of 0.05% by weight based on the weight of the pulp. A cationated starch (Catel 5, manufactured by Oji National Co., Ltd.) was added thereto in an amount of 0.4% by weight based on the weight of the pulp. The paper material thus obtained was processed to make a paper having a basis weight of 77 g/m$^2$ and a formation index of 20. The paper thus obtained was then machine-calendered to adjust an apparent density thereof to 0.80 g/cm$^3$. As a result, a base paper having an air permeability of 15 seconds was obtained.

To the base paper thus obtained was applied a coating solution containing finely divided synthetic amorphous silica particles (Mizukasil P-78D, manufactured by Mizusawa Industrial Chemicals, Ltd.; specific surface area: 350 m$^2$/g) in an amount of 72%, a silanol-modified vinyl alcohol copolymer (PVA2130, manufactured by Kuraray Co., Ltd.) in an amount of 23% as an aqueous adhesive and an aqueous cationic polymer (Epomin P1000, manufactured by Nippon Shokubai Kagaku Kogyo Co., Ltd.) in an amount of 5% as a waterproofing agent, to thereby form a coating layer having a dried coverage of 7 g/m$^2$. The coated surface was finished so as to have a Beck smoothness of 28 seconds to obtain a recording paper of Example 1.

EXAMPLE 2

A pulp composed of a 4:1 mixture of LBKP and NBKP was beaten to a freeness of 450 ml C.S.F. The same filler, internal sizing agent and cationated starch as in Example 1 were added to the pulp in the same amounts as in Example 1. The paper material thus obtained was processed to make a paper having a basis weight of 77 g/m$^2$ and a formation index of 20. The paper thus obtained was then machine-calendered to adjust an apparent density thereof to 0.84 g/cm$^3$. As a result, a base paper having an air permeability of 15 seconds was obtained.

On the base paper thus obtained was then provided the same coating layer as in Example 1 to obtain a recording paper of Example 2.

EXAMPLE 3

LBKP was beaten to a freeness of 450 ml C.S.F. The same filler, internal sizing agent and cationated starch as in Example 1 were added to the pulp in the same amounts as in Example 1. The paper material thus obtained was processed to make a paper having a basis weight of 77 g/m$^2$ and a formation index of 20. The paper thus obtained was then machine-calendered to adjust an apparent density thereof to 0.90 g/cm$^3$. As a result, a base paper having an air permeability of 15 seconds was obtained.

On the base paper thus obtained was then provided the same coating layer as in Example 1 to obtain a recording paper of Example 3.

EXAMPLE 4

The same paper material as in Example 3 was processed to make a paper having a basis weight of 77 g/m$^2$ and a formation index of 20. The paper thus obtained was then machine-calendered to adjust an apparent density thereof to 0.80 g/cm$^3$. As a result, a base paper having an air permeability of 8 seconds was obtained.

On the base paper thus obtained was then provided the same coating layer as in Example 1 to obtain a recording paper of Example 4.

EXAMPLE 5

LBKP was beaten to a freeness of 470 ml C.S.F. Calcium carbonate light (TP123, manufactured by Okutama Kogyo K. K.) was then added to the pulp as a filler to be in an amount of 10% by weight based on the total weight of a base paper. The same internal sizing agent and cationated starch as in Example 1 were added thereto in the same amounts as in Example 1. The paper material thus obtained was processed to make a paper having a basis weight of 77 g/m$^2$ and a formation index of 20. The paper thus obtained was then machine-calendered to adjust an apparent density thereof to 0.84 g/cm$^3$. As a result, a base paper having an air permeability of 8 seconds was obtained.

On the base paper thus obtained was then provided the same coating layer as in Example 1 to obtain a recording paper of Example 5.

EXAMPLE 6

The same paper material as in Example 5 was processed to make a paper having a basis weight of 77 g/m$^2$ and a formation index of 25. The paper thus obtained was then machine-calendered to adjust an apparent density thereof to 0.84 g/cm$^3$. As a result, a base paper having an air permeability of 8 seconds was obtained.

On the base paper thus obtained was then provided the same coating layer as in Example 1 to obtain a recording paper of Example 6.

EXAMPLE 7

To the same base paper as in Example 6 was applied a coating solution containing finely divided synthetic amorphous silica particles (Mizukasil P-87, manufactured by Mizusawa Industrial Chemicals, Ltd.; specific surface area: 280 m$^2$/g) in an amount of 72% and the same aqueous adhesive and waterproofing agent as in Example 1 in the same amounts as in Example 1, to thereby form a coating layer having a dried coverage of 7 g/m$^2$. The coated surface was then finished so as to have a Beck smoothness of 28 seconds to obtain a recording paper of Example 7.

EXAMPLE 8

The same pulp as in Example 3 was used. Calcium carbonate light (TP122, manufactured by Okutama Kogyo K. K.) was added to the pulp to be in an amount of 10% by weight based on the total weight of a base paper. The same internal sizing agent and cationated starch as in Example 1 were then added thereto in the same amounts as in Example 1. The paper material thus obtained was processed to make a paper having a basis weight of 70 g/m$^2$ and a formation index of 20. The paper thus obtained was then machine-calendered to adjust an apparent density thereof to 0.80 g/cm$^3$. As a result, a base paper having an air permeability of 8 seconds was obtained.

On the base paper thus obtained was then provided the same coating layer as in Example 1 to obtain a recording paper of Example 8.

EXAMPLE 9

The same paper material as in Example 8 was processed to make a paper having a basis weight of 90 g/m$^2$ and a formation index of 20. The paper thus obtained was then machine-calendered to adjust an apparent density thereof to 0.80 g/cm$^3$. As a result, a base paper having an air permeability of 15 seconds was obtained.

On the base paper thus obtained was then provided the same coating layer as in Example 1 to obtain a recording paper of Example 9.

EXAMPLE 10

To the same base paper as in Example 5 was applied the same coating solution as in Example 1 to form a coating layer having a dried coverage of 4 g/m$^2$. The coated surface was finished so as to have a Beck smoothness of 28 seconds to obtain a recording paper of Example 10.

EXAMPLE 11

To the same base paper as in Example 5 was applied the same coating solution as in Example 1 to form a coating layer having a dried coverage of 10 g/m$^2$. The coated surface was finished so as to have a Beck smoothness of 28 seconds to obtain a recording paper of Example 11.

EXAMPLE 12

To the same base paper as in Example 2 was applied a coating solution containing pigments in an amount of 72%, which is a 90: 10 mixture of finely divided synthetic amorphous silica particles (Mizukasil P-78D, manufactured by Mizusawa Industrial Chemicals, Ltd.; specific surface area: 350 m$^2$/g) and finely divided synthetic amorphous silica particles (Mizukasil P-526N, manufactured by Mizusawa Industrial Chemicals, Ltd.; specific surface area: 150 m$^2$/g), and the same aqueous adhesive and waterproofing agent as in Example 1 in the same amounts as in Example 1, to thereby form a coating layer having a dried coverage of 7 g/m$^2$. The coated surface was then finished so as to have a Beck smoothness of 28 seconds to obtain a recording paper of Example 12.

EXAMPLE 13

To the same base paper as in Example 2 was applied a coating solution containing pigments in an amount of 72%, which is a 75:25 mixture of finely divided synthetic amorphous silica particles (Mizukasil P-78D, manufactured by Mizusawa Industrial Chemicals, Ltd.; specific surface area: 350 $m^2/g$) and finely divided synthetic amorphous silica particles (Mizukasil P-526N, manufactured by Mizusawa Industrial Chemicals, Ltd.; specific surface area: 150 $m^2/g$), and the same aqueous adhesive and waterproofing agent as in Example 1 in the same amounts as in Example 1, to thereby form a coating layer having a dried coverage of 7 $g/m^2$. The coated surface was then finished so as to have a Beck smoothness of 28 seconds to obtain a recording paper of Example 13.

EXAMPLE 14

To the same base paper as in Example 2 was applied a coating solution containing pigments in an amount of 72%, which is a 50:50 mixture of finely divided synthetic amorphous silica particles (Mizukasil P-78D, manufactured by Mizusawa Industrial Chemicals, Ltd.; specific surface area: 350 $m^2/g$) and finely divided synthetic amorphous silica particles (Mizukasil P-526N, manufactured by Mizusawa Industrial Chemicals, Ltd.; specific surface area: 150 $m^2/g$), and the same aqueous adhesive and waterproofing agent as in Example 1 in the same amounts as in Example 1, to thereby form a coating layer having a dried coverage of 7 $g/m^2$. The coated surface was then finished so as to have a Beck smoothness of 28 seconds to obtain a recording paper of Example 14.

EXAMPLE 15

To the same base paper as in Example 2 was applied a coating solution containing pigments in an amount of 72%, which is a 75:25 mixture of finely divided synthetic amorphous silica particles (Mizukasil P-78D, manufactured by Mizusawa Industrial Chemicals, Ltd.; specific surface area: 350 $m^2/g$) and finely divided synthetic amorphous silica particles (Mizukasil P-802, manufactured by Mizusawa Industrial Chemicals, Ltd.; specific surface area: 200 $m^2/g$), and the same aqueous adhesive and waterproofing agent as in Example 1 in the same amounts as in Example 1, to thereby form a coating layer having a dried coverage of 7 $g/m^2$. The coated surface was then finished so as to have a Beck smoothness of 28 seconds to obtain a recording paper of Example 15.

COMPARATIVE EXAMPLE 1

LBKP was beaten to a freeness of 440 ml C.S.F. The same filler, internal sizing agent and cationated starch as in Example 1 were added to the pulp in the same amounts as in Example 1. The paper material thus obtained was processed to make a paper having a basis weight of 77 $g/m^2$ and a formation index of 20. The paper thus obtained was then machine-calendered to adjust an apparent density thereof to 0.79 $g/cm^3$. As a result, a base paper having an air permeability of 8 seconds was obtained.

On the base paper thus obtained was then provided the same coating layer as in Example 1 to obtain a recording paper of Comparative Example 1.

COMPARATIVE EXAMPLE 2

LBKP was beaten to a freeness of 440 ml C.S.F. The same filler, internal sizing agent and cationated starch as in Example 1 were added to the pulp in the same amounts as in Example 1. The paper material thus obtained was processed to make a paper having a basis weight of 77 $g/m^2$ and a formation index of 20. The paper thus obtained was then machine-calendered to adjust an apparent density thereof to 0.91 $g/cm^3$. As a result, a base paper having an air permeability of 15 seconds was obtained.

On the base paper thus obtained was then provided the same coating layer as in Example 1 to obtain a recording paper of Comparative Example 2.

COMPARATIVE EXAMPLE 3

The same pulp as in Example 1 was used. Calcium carbonate light (TP123, manufactured by Okutama Kogyo K. K.) was added to the pulp to be in an amount of 10% by weight based on the total weight of a base paper. The same internal sizing agent and cationated starch as in Example 1 were then added thereto in the same amounts as in Example 1. The paper material thus obtained was processed to make a paper having a basis weight of 77 $g/m^2$ and a formation index of 20. The paper thus obtained was then machine-calendered to adjust an apparent density thereof to 0.80 $g/cm^3$. As a result, a base paper having an air permeability of 16 seconds was obtained.

On the base paper thus obtained was then provided the same coating layer as in Example 1 to obtain a recording paper of Comparative Example 3.

COMPARATIVE EXAMPLE 4

The same pulp as in Example 2 was used. The same filler as in Comparative Example 3 was added to the pulp in the same amount as in Comparative Example 3. The same internal sizing agent and cationated starch as in Example 1 were then added thereto in the same amounts as in Example 1. The paper material thus obtained was processed to make a paper having a basis weight of 77 $g/m^2$ and a formation index of 20. The paper thus obtained was then machine-calendered to adjust an apparent density thereof to 0.84 $g/cm^3$. As a result, a base paper having an air permeability of 16 seconds was obtained.

On the base paper thus obtained was then provided the same coating layer as in Example 1 to obtain a recording paper of Comparative Example 4.

COMPARATIVE EXAMPLE 5

The same pulp as in Example 3 was used. The same filler as in Comparative Example. 3 was added to the pulp in the same amount as in Comparative Example 3. The same internal sizing agent and cationated starch as in Example 1 were then added thereto in the same amounts as in Example 1. The paper material thus obtained was processed to make a paper having a basis weight of 77 $g/m^2$ and a formation index of 20. The paper thus obtained was then machine-calendered to adjust an apparent density thereof to 0.90 $g/cm^3$. As a result, a base paper having an air permeability of 16 seconds was obtained.

On the base paper thus obtained was then provided the same coating layer as in Example 1 to obtain a recording paper of Comparative Example 5.

COMPARATIVE EXAMPLE 6

The same paper material as in Example 3 was processed to make a paper having a basis weight of 77 g/m$^2$ and a formation index of 19. The paper thus obtained was then machine-calendered to adjust an apparent density thereof to 0.90 g/cm$^3$. As a result, a base paper having an air permeability of 15 seconds was obtained.

On the base paper thus obtained was then provided the same coating layer as in Example 1 to obtain a recording paper of Comparative Example 6.

COMPARATIVE EXAMPLE 7

The same paper material as in Example 3 was processed to make a paper having a basis weight of 77 g/m$^2$ and a formation index of 12. The paper thus obtained was then machine-calendered to adjust an apparent density thereof to 0.90 g/cm$^3$. As a result, a base paper having an air permeability of 15 seconds was obtained.

On the base paper thus obtained was then provided the same coating layer as in Example 1 to obtain a recording paper of Comparative Example 7.

COMPARATIVE EXAMPLE 8

The same paper material as in Example 3 was processed to make a paper having a basis weight of 77 g/m$^2$ and a formation index of 19. The paper thus obtained was then machine-calendered to adjust an apparent density thereof to 0.90 g/cm$^3$. As a result, a base paper having an air permeability of 8 seconds was obtained.

On the base paper thus obtained was then provided the same coating layer as in Example 1 to obtain a recording paper of Comparative Example 8.

COMPARATIVE EXAMPLE 9

The same paper material as in Example 1 was processed to make a paper having a basis weight of 77 g/m$^2$ and a formation index of 12. The paper thus obtained was then machine-calendered to adjust an apparent density thereof to 0.91 g/cm$^3$. As a result, a base paper having an air permeability of 20 seconds was obtained.

On the base paper thus obtained was then provided the same coating layer as in Example 1 to obtain a recording paper of Comparative Example 9.

COMPARATIVE EXAMPLE 10

To the same base paper as in Example 5 was applied a coating solution containing finely divided synthetic amorphous silica particles (Mizukasil P-802, manufactured by Mizusawa Industrial Chemicals, Ltd.; specific surface area: 200 m$^2$/g) in an amount of 72% and the same aqueous adhesive and waterproofing agent as in Example 1 in the same amounts as in Example 1, to thereby form a coating layer having a dried coverage of 7 g/m$^2$. The coated surface was then finished so as to have a Beck smoothness of 28 seconds to obtain a recording paper of Comparative Example 10.

COMPARATIVE EXAMPLE 11

To the same base paper as in Example 2 was applied the same coating solution as in Example 1, to thereby form a coating layer having a dried coverage of 3 g/m$^2$. The coated surface was then finished so as to have a Beck smoothness of 28 seconds to obtain a recording paper of Comparative Example 11.

COMPARATIVE EXAMPLE 12

To the same base paper as in Example 2 was applied the same coating solution as in Example 1, to thereby form a coating layer having a dried coverage of 11 g/m$^2$. The coated surface was then finished so as to have a Beck smoothness of 28 seconds to obtain a recording paper of Comparative Example 12.

COMPARATIVE EXAMPLE 13

To the same base paper as in Example 2 was applied a coating solution containing pigments in an amount of 72%, which is a 40:60 mixture of finely divided synthetic amorphous silica particles (Mizukasil P-78D, manufactured by Mizusawa Industrial Chemicals, Ltd.; specific surface area: 350 m$^2$/g) and finely divided synthetic amorphous silica particles (Mizukasil P-526N, manufactured by Mizusawa Industrial Chemicals, Ltd.; specific surface area: 150 m$^2$/g) and the same aqueous adhesive and waterproofing agent as in Example 1 in the same amounts as in Example 1, to thereby form a coating layer having a dried coverage of 7 g/m$^2$. The coated surface was then finished so as to have a Beck smoothness of 28 seconds to obtain a recording paper of Comparative Example 13.

COMPARATIVE EXAMPLE 14

To the same base paper as in Example 2 was applied a coating solution containing pigments in an amount of 72%, which is a 75:25 mixture of finely divided synthetic amorphous silica particles (Mizukasil P-78D, manufactured by Mizusawa Industrial Chemicals, Ltd.; specific surface area: 350 m$^2$/g) and finely divided synthetic amorphous silica particles (Mizukasil P-832, manufactured by Mizusawa Industrial Chemicals, Ltd.; specific surface area: 60 m$^2$/g) and the same aqueous adhesive and waterproofing agent as in Example 1 in the same amounts as in Example 1, to thereby form a coating layer having a dried coverage of 7 g/m$^2$. The coated surface was then finished so as to have a Beck smoothness of 28 seconds to obtain a recording paper of Comparative Example 14.

(Evaluation)

On each of these recording papers was recorded an image with an aqueous ink having a viscosity of from 1 to 8 cp and a surface tension of not more than 40 dyn/cm using a printer equipped with four ink jet recording heads (each head is for black, cyan, magenta and yellow, respectively ) capable of recording at a density of 300 dpi. These recording papers were then each examined and evaluated for image density unevenness, mixed color bleeding, color definition, resolution and strength of a coating layer. The results are set forth in the tables below.

The evaluation of the various properties were effected in the following manner.

For the evaluation of image density unevenness, a 50% halftone pattern was printed with a black ink on the recording paper. The image thus obtained was then visually observed and evaluated in accordance with the following criteria:

E: No density unevenness observed

G: Slight density unevenness occurs but causes no problem for practical use

F: Some density unevenness occurs

P: Unacceptable density unevenness occurs

For the evaluation of mixed color bleeding, a 1 cm square solid image was printed with a magenta ink on the center of a 2 cm square solid image previously printed with a cyan ink. By utilizing the knowledge that the area on which magenta is superimposed on cyan changes into blue in accordance with the substractive color mixture, bleeding at the border of the cyan area with the blue area was regarded as "mixed color bleeding". The mixed color bleeding was visually observed and evaluated in accordance with the following criteria:

E: No mixed color bleeding observed

G: Slight mixed color bleeding occurs but causes no problem for practical use

F: Some mixed color bleeding occurs

P: Unacceptable mixed color bleeding occurs

For the evaluation of color definition, the image was visually observed and evaluated for color developability and color definition in accordance with the following criteria:

E: Very good

G: Good

F: Fair

P: Poor

For the evaluation of resolution, Chinese characters 淺 and 蒼 in 8-point Ming-style type were printed on the recording paper. These letters were visually evaluated for understandability and quality of the printed characters in accordance with the following criteria:

E: Very good understandability and quality

G: Good understandability and quality

F: Slightly defaced character

P: Defaced character

For the evaluation of the strength of a coating layer, the recording paper was bent. A 2-kg metallic roll was rolled over the bent area. The degree of peeling of the coating layer was observed and evaluated in the following criteria:

E: No peeling observed

G: Slight peeling observed but causes no problem for practical use

F: Some peeling observed

P: Significant peeling observed

TABLE 1

| | Example No. | | | | | | | |
|---|---|---|---|---|---|---|---|---|
| (Properties) | 1 | 2 | 3 | 4 | 5 | 6 | 7 | 8 |
| Basis weight of base paper | 77 | 77 | 77 | 77 | 77 | 77 | 77 | 77 |
| Apparent density of base paper | 0.80 | 0.84 | 0.90 | 0.80 | 0.84 | 0.84 | 0.84 | 0.80 |
| Air permeability of base paper | 15 | 15 | 15 | 8 | 8 | 8 | 8 | 8 |
| Formation index of base paper | 20 | 20 | 20 | 20 | 25 | 25 | 20 | 20 |
| Specific surface area of main pigment (1) | 350 | 350 | 350 | 350 | 350 | 350 | 280 | 350 |
| Specific surface area of additional pigment (2) | — | — | — | — | — | — | — | — |

TABLE 1-continued

| | Example No. | | | | | | | |
|---|---|---|---|---|---|---|---|---|
| (Properties) | 1 | 2 | 3 | 4 | 5 | 6 | 7 | 8 |
| (1):(2) | — | — | — | — | — | — | — | — |
| Dried coverage | 7 | 7 | 7 | 7 | 7 | 7 | 7 | 7 |
| Mixed color bleeding | E | G | G | E | E | E | G | E |
| Image density unevenness | G | G | G | G | G | E | E | G |
| Color definition | E | E | E | E | E | E | G | E |
| Resolution | E | E | G | E | E | E | E | E |
| Strength of coating layer | E | E | E | E | E | E | E | E |

TABLE 2

| | Example No. | | | | | | |
|---|---|---|---|---|---|---|---|
| (Properties) | 9 | 10 | 11 | 12 | 13 | 14 | 15 |
| Basis weight of base paper | 90 | 77 | 77 | 77 | 77 | 77 | 77 |
| Apparent density of base paper | 0.90 | 0.84 | 0.84 | 0.84 | 0.84 | 0.84 | 0.84 |
| Air permeability of base paper | 15 | 8 | 8 | 15 | 15 | 15 | 15 |
| Formation index of base paper | 20 | 20 | 20 | 20 | 20 | 20 | 20 |
| Specific surface area of main pigment (1) | 350 | 350 | 350 | 350 | 350 | 350 | 350 |
| Specific surface area of additional pigment (2) | — | — | — | 150 | 150 | 150 | 200 |
| (1):(2) | — | — | — | 90:10 | 75:25 | 50:50 | 75:25 |
| Dried coverage | 7 | 4 | 10 | 7 | 7 | 7 | 7 |
| Mixed color bleeding | G | G | G | E | E | E | E |
| Image density unevenness | G | G | G | G | G | G | G |
| Color definition | E | G | E | E | E | E | E |
| Resolution | G | G | G | E | E | E | E |
| Strength of coating layer | E | E | G | E | E | E | E |

TABLE 3

| | Comparative Example No. | | | | | | | |
|---|---|---|---|---|---|---|---|---|
| (Properties) | 1 | 2 | 3 | 4 | 5 | 6 | 7 | 8 |
| Basis weight of base paper | 77 | 77 | 77 | 77 | 77 | 77 | 77 | 77 |
| Apparent density of base paper | 0.79 | 0.91 | 0.80 | 0.84 | 0.90 | 0.90 | 0.90 | 0.80 |
| Air permeability of base paper | 8 | 15 | 16 | 16 | 16 | 15 | 15 | 8 |
| Formation index of base paper | 20 | 20 | 20 | 20 | 20 | 19 | 12 | 19 |
| Specific surface area of main pigment (1) | 350 | 350 | 350 | 350 | 350 | 350 | 350 | 350 |
| Specific surface area of additional pigment (2) | — | — | — | — | — | — | — | — |
| (1):(2) | — | — | — | — | — | — | — | — |
| Dried coverage | 7 | 7 | 7 | 7 | 7 | 7 | 7 | 7 |
| Mixed color | E | F | F | F | F | F | F | G |

TABLE 3-continued

| (Properties) | Comparative Example No. 1 | 2 | 3 | 4 | 5 | 6 | 7 | 8 |
|---|---|---|---|---|---|---|---|---|
| bleeding | | | | | | | | |
| Image density unevenness | F | G | G | G | G | F | P | F |
| Color definition | E | E | E | E | E | E | E | E |
| Resolution | E | F | F | F | F | F | F | G |
| Strength of coating layer | E | E | E | E | E | E | E | E |

TABLE 4

| (Properties) | Comparative Example No. 9 | 10 | 11 | 12 | 13 | 14 |
|---|---|---|---|---|---|---|
| Basis weight of base paper | 77 | 77 | 77 | 77 | 77 | 77 |
| Apparent density of base paper | 0.91 | 0.84 | 0.84 | 0.84 | 0.84 | 0.84 |
| Air permeability of base paper | 20 | 8 | 15 | 15 | 15 | 15 |
| Formation index of base paper | 12 | 20 | 20 | 20 | 20 | 20 |
| Specific surface area of main pigment (1) | 350 | 200 | 300 | 300 | 300 | 300 |
| Specific surface area of additional pigment (2) | — | — | — | — | 150 | 60 |
| (1):(2) | — | — | — | — | 40:60 | 75:25 |
| Dried coverage | 7 | 7 | 3 | 11 | 7 | 7 |
| Mixed color bleeding | P | F | F | E | G | G |
| Image density unevenness | P | G | P | E | G | G |
| Color definition | G | F | P | E | F | F |
| Resolution | P | G | F | E | G | G |
| Strength of coating layer | E | E | E | G | E | E |

As is shown in the results of the tables, the ink jet recording paper of the present invention, although having a coating layer applied in a low coating amount, can provide a high quality image recorded thereon with little or no density unevenness and mixed color bleeding, and further, with an excellent color definition and resolution by employing the constitution as described above. Further, the recording paper of the present invention causes no troubles such as deterioration in strength and powder falling because of the low coating amount. Therefore, the production cost is reduced and the resulting recording paper exhibits a touch and external appearance close to that of ordinary paper.

While the invention has been described in detail and with reference to specific embodiments thereof, it will be apparent to one skilled in the art that various changes and modifications can be made therein without departing from the spirit and scope thereof.

What is claimed is:

1. An ink jet recording paper, which comprises:

(a) a base paper having an apparent density according to JIS-P8118 of from 0.80 to 0.90 g/cm$^3$, an air permeability according to JIS-P8117 of from 5 to 15 seconds and a formation index of not less than 20; and (b) a coating layer provided on at least one surface of said base paper, said coating layer having a dried coverage of from 4 to 10 g/m$^2$ and comprising (1) a white pigment having a BET specific surface area of from not less than 250 m$^2$/g to less than 400 m$^2$/g and (2) an adhesive.

2. The ink jet recording paper according to claim 1, wherein said base paper exhibits a stöckigt sizing degree according to JIS-P8122 of from 5 to 70 seconds.

3. The ink jet recording paper according to claim 4, wherein said base paper exhibits a stöckigt sizing degree according to JIS-P8122 of from 5 to 70 seconds.

4. An ink jet recording paper comprising:

(a) a base paper having an apparent density according to JIS-P8118 of from 0.80 to 0.90 g/cm$^3$, an air permeability according to JIS-P8117 of from 5 to 15 seconds and a formation index of not less than 20; and (b) a coating layer provided on at least one surface of said base paper, said coating layer having a dried coverage of from 4 to 10 g/m$^2$ and comprising (1) white pigments and (2) an adhesive, wherein said white pigments contain a white pigment having a BET specific surface area of from not less than 100 m$^2$/g to less than 250 m$^2$/g in an amount of from 10 to 50% by weight, and a white pigment having a BET specific surface area of from not less than 250 m$^2$/g to less than 400 m$^2$/g in an amount of from 50 to 90% by weight, each based on the total weight of the white pigments.

5. The ink jet recording paper according to claim 1, wherein said base paper has a basis weight of from 70 to 90 g/m$^2$.

6. The ink jet recording paper according to claim 4, wherein said base paper has a basis weight of from 70 to 90 g/m$^2$.

* * * * *